US006609938B1

(12) United States Patent
Pither

(10) Patent No.: US 6,609,938 B1
(45) Date of Patent: Aug. 26, 2003

(54) PROPELLER PROTECTOR SLIPPER

(76) Inventor: Allan Walter Pither, 4221 NW. 18th Pl., Gainesville, FL (US) 32605

( * ) Notice: Subject to any disclaimer, the term of this patent is extended or adjusted under 35 U.S.C. 154(b) by 0 days.

(21) Appl. No.: 10/131,393

(22) Filed: Apr. 23, 2002

(51) Int. Cl.[7] ..... B63H 5/16
(52) U.S. Cl. ..... 440/71; 150/157
(58) Field of Search ..... 440/71, 72; 150/157; 416/247 A

(56) References Cited

U.S. PATENT DOCUMENTS

| | | | |
|---|---|---|---|
| 2,244,217 | A | 6/1941 | Pries |
| 3,889,624 | A | 6/1975 | Balius |
| 4,013,033 | A | 3/1977 | Porter et al. |
| 5,066,254 | A | 11/1991 | Bass et al. |
| D322,593 | S | 12/1991 | Kearney et al. |
| 5,176,550 | A | 1/1993 | Hooper |
| 5,246,345 | A | 9/1993 | Adams, Jr. |
| 5,273,399 | A | 12/1993 | Ojeda |
| D344,456 | S | 2/1994 | Argondizza |
| 5,389,021 | A | 2/1995 | Padgett |
| 5,470,262 | A | 11/1995 | Bustillo |
| 5,494,465 | A | 2/1996 | Jenkins |
| 5,664,975 | A | 9/1997 | Carlisle |
| 5,759,075 | A | 6/1998 | Steep et al. |
| 5,904,603 | A | 5/1999 | Embry et al. |
| 5,928,042 | A | 7/1999 | Quiggins |
| 5,975,969 | A | 11/1999 | White |
| D419,518 | S | 1/2000 | Harrison |
| D424,503 | S | 5/2000 | Rudofsky |
| 6,152,064 | A | 11/2000 | Morton |
| 2001/0036776 | A1 | 11/2001 | Raps |

*Primary Examiner*—Jesus D. Sotelo
(74) *Attorney, Agent, or Firm*—Saliwanchik, Lloyd & Saliwanchik

(57) ABSTRACT

Propeller protector slipper to be used on inboard and outboard motors of boats that are anchored, drifting, aground, docked, in storage, or out of water in transit. The propeller protector slipper ensures protection for the propeller from elements that cause pitting and damage to the propeller as well as minimizing propeller related injuries. The protector propeller slipper also provides a gage for projecting the distance of the propeller of a trailored boat from a following vehicle.

20 Claims, 3 Drawing Sheets

PROPELLER PROTECTOR SLIPPER

BACKGROUND OF INVENTION

The present invention concerns propeller protectors that are attached over propellers of outboard or inboard motors to protect individuals from accidental injury when in proximity to the propeller. In particular, the present invention relates to a propeller protector slipper that easily slides over and attaches to a propeller thus increasing the safety of the user and other individuals from the propeller blades, whether the propeller is up or down, trailoring, in water, or in storage. Advantageously, the protective slipper of the subject invention protects the propeller from damage.

Typically, the edges of propeller blades are very sharp and hazardous to any individuals within their vicinity, including boating passengers. People boarding or disembarking from boats may injure themselves on the sharp edges of the propeller blades. Such injuries often require stitches and are subject to infection based on the condition of the propeller and ambient water quality. Unfortunately, fatal injuries such as drowning may also result from individual contact with unprotected propeller blades.

Often, boat or pleasure-craft operators maneuver and anchor their craft in relatively shallow water, sometimes in areas where the boat comes in contact with the bottom of a lake or river, so that passengers can casually wade in the water and touch the bottom of the lake or sea while swimming. In order to maneuver in shallow water, the outboard motor or outdrive portion of stem drive systems may be concealed from view when in a functional position or when angled upward to prevent the propeller from contacting the bottom surface. In such cases, the likelihood of injury resulting from contact with exposed propeller blades when swimming or wading in their vicinity is greatly increased. Further, where swimmers are in water areas subject to tidal or general current, there is the possibility that the current will effect the swimmer's ability to evade contact with the propeller. Therefore, entering into and exiting from the water, as well as conducting recreational activities in the water, are often hazardous activities when the outboard portion of the stem drive is raised or lowered.

Exposed propellers also present a risk of injury to those individuals outside of the water. When the boat is docked, on a trailer, or out of the water in storage, individuals are subject to injury should they fall onto and cut themselves on the propeller blades. In particular, children are especially prone to injuries when playing near the sharp blades of an exposed propeller protruding from a boat.

When trailoring a boat or pleasure-craft, the outboard motor is locked in the angled position so that the propeller and skeg project from the craft. This can be hazardous to following vehicles as drivers may not appreciate how far the propeller and skeg project from the boat. In addition, the position of the propeller is also hazardous to pedestrians who may bump into the propeller when walking or performing activities in the vicinity of the propeller.

Finally, exposed propellers and lower units are susceptible to damage when in shallow waters or in transit. When a boat is docked or out of water in transit, the propeller is subjected to many elements (e.g. rocks or leaves) that damage the propeller blades. Additional debris may also settle in the exhaust hub inhibiting exhaust gases and water coolant discharge. Generally, the cost to repair or replace a propeller, an engine, or an outboard or outdrive is substantial.

Safety devices and protective devices have been used in association with boat propellers. For example, the protective cover disclosed in U.S. Pat. No. 5,494,465 is fashioned such that (1) the user must stand in front of the propeller to attach the cover and (2) the cover must enclose both the skeg and the propeller. U.S. Pat. No. 5,664,975 is directed to a reflective safety bag having a flat bottom wall. This safety bag includes a drawstring to secure the bag over the propeller. The disadvantage of this bag is that it is pliable, requiring a user to adjust the mouth of the opening of the bag and bring their hands within close proximity if not having to actually touch the blades in order to place the bag over the propeller. Further difficulties arise where the propeller is located beneath an anticavitation plate with a trim tab or where a skeg protrudes. In situations where boat movement occurs due to tidal or general current, this bag is difficult to install and may result in injury to the user. Further propeller protectors include U.S. Pat. No. Des. 322,593 which discloses a design for a boat propeller shield and U.S. Pat. No. 5,246,345 which discloses a propeller cover in which an enclosure is formed by two hinged shell halves. The design patent does not provide for ease of attachment and detachment of the shield because the shield is permanently affixed to the drive shaft. U.S. Pat. No. 5,246,345 provides a cover that is unwieldy for underwater attachment to a propeller and has the potential for injuring the user when attempting to attach the cover to the propeller. Finally, none of the current examples of propeller protectors contemplate a protector for a two bladed propeller.

Therefore, current propeller protective devices are difficult to install based on their general location above the skeg and beneath the anticavitation plate with trim tab, especially in waters where current is present. In such instances, the user may be subject to harm when securing the device over a propeller on a moving boat. There remains a need for an inexpensive propeller protector slipper that is readily installed and non-permanent, which provides protection against injuries to users and individuals as well as protecting the propeller during transport or storage.

BRIEF SUMMARY OF THE INVENTION

The present invention provides a propeller protector slipper that is easily attached to propellers of outboard and inboard motors. In one aspect, the propeller protector slipper of the subject invention is easy to use and is not attached permanently to a motor. Additionally, the present slipper is attached over a propeller without having the user face the propeller or place their hands in close proximity to or on the blades of the propeller. By providing a means for longitudinally sliding the subject propeller slipper over a propeller from either port or starboard direction, user injuries are limited.

In an embodiment, specifically exemplified herein, a housing unit is used to surround a propeller. The housing unit includes at least one side portion that is cut away to accommodate a propeller and a back surface that is cut away to provide an opening through which the lower unit gear housing hub may be inserted to enclose the propeller within the housing unit. To secure the housing unit over a propeller, the housing unit includes a securing means. The securing means prevents the housing unit from detaching from the propeller either under water or while in storage or transit. In a related specific embodiment, the housing unit is secured over a propeller using a dowel rod and clevis pin.

To slip the housing unit over the propeller, minimal longitudinal force is applied in either the starboard or the port direction. According to the present invention, the housing unit is easily slipped over a propeller of an outboard/outdrive motor that is located between three different structures: aft of the lower unit gear housing, below the anticavitation plate, and forward of the trim tab. This is particularly useful in that the user is not facing the propeller and is not liable to harm himself when attempting to secure the subject invention over a propeller. By slipping the housing unit over the propeller in a longitudinal direction, the propeller protector according to the present invention ensures that the user's hands do not get injured in the process of securing the housing unit over the propeller.

Minimal longitudinal force is applied to the housing unit when slipping the housing unit over a propeller of an inboard motor. Generally with inboard motors (depending on the type of vessel), the propeller shaft is a through hull propeller shaft that emerges from the bottom of the boat. As with an outboard motor, the housing unit may be slipped over a propeller of an inboard motor from either the starboard or the port direction. The housing unit is slipped easily over a propeller of an inboard motor in a longitudinal direction, below the bottom structure of the boat and forward of the rudder to the stem of the propeller shaft strut.

The housing unit may be constructed from a variety of materials and in a variety of shapes to ensure coverage over the propeller, so long as the shape accommodates the ability to longitudinally slip the housing unit over the propeller. For example, the housing unit may be composed of buoyant material to provide ease of recovery should the housing unit fall overboard. Where the shape of the housing unit more closely resembles the shape of the propeller, the greater the protection against detachment of the housing unit from the propeller due to vibration, wind, and water current.

Specifically exemplified herein is a housing unit in the shape of a rectangle. The housing unit has a cut away portion in the back surface of the housing unit to accommodate the lower unit gear housing exhaust hub. In addition, a side surface of the housing unit is cut away to provide an opening through which a propeller may be inserted and enclosed within the housing unit. The housing unit can be secured over the propeller by, for example, inserting a dowel rod through aligned bores located at the top and bottom surfaces of the housing unit near the cut away side surface, and securing the dowel rod with a clevis pin.

In another embodiment of the present invention, the interior of the housing unit includes a cushioning means to protect the propeller from any force of impact generated by an object that strikes the housing unit. Yet another embodiment of the present invention provides a housing unit with reinforcement material surrounding the cut-away portion that accommodates the propeller shaft. Additional structural reinforcement known to the skilled artisan may be provided along the exterior surface of the housing unit. For example, the sides, front and back surfaces of the housing unit may be bent or include stiffening ribs to provide structural reinforcement. A further embodiment of the present invention includes a means for making the housing unit readily visible to individuals. Specifically, reflective tape or a warning sign may be secured to the exterior of a housing unit to ensure visibility of the propeller protector slipper for those vehicles following a boat in transit.

DETAILED DISCLOSURE OF THE INVENTION

Figure 2:
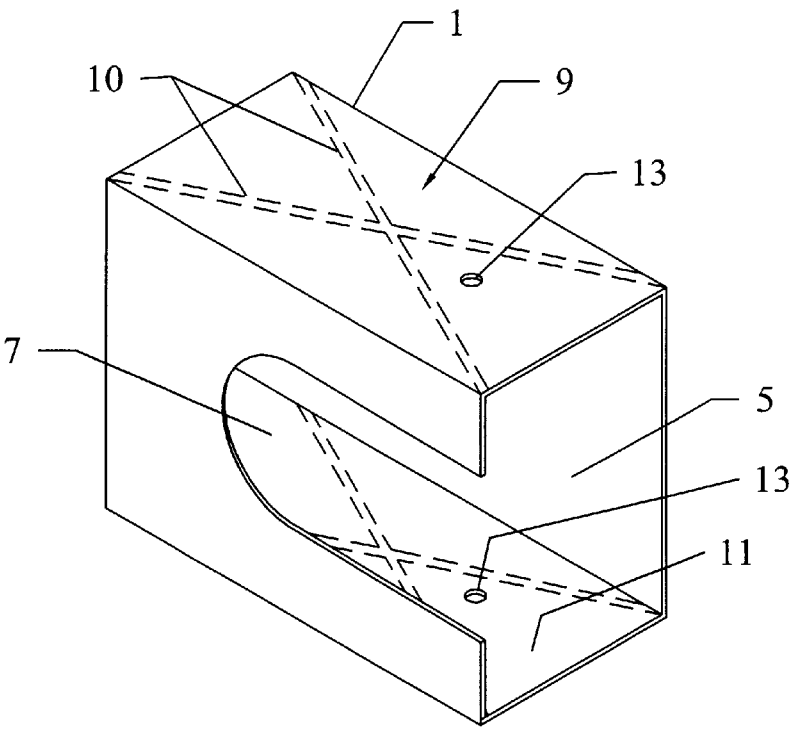
FIG. 2 is a perspective view of an embodiment of the propeller protector slipper.
Figure 1:
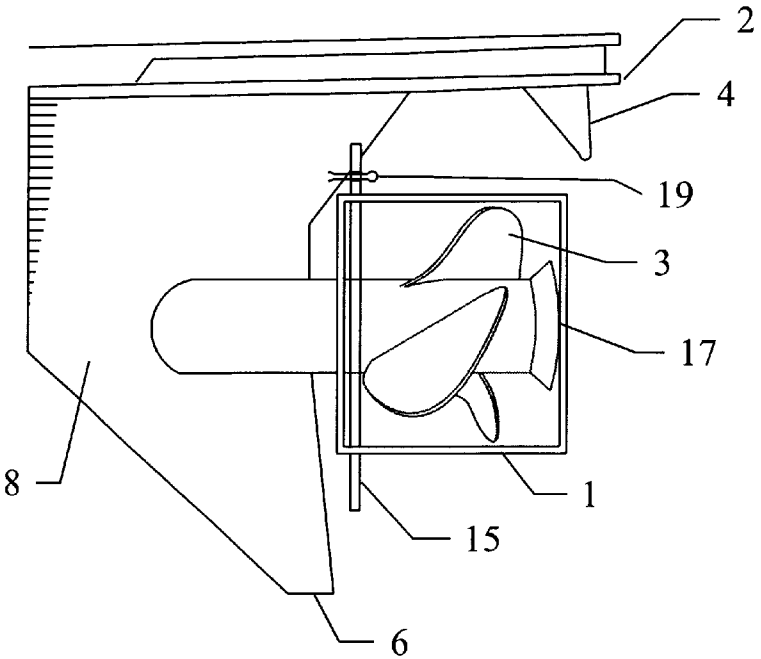
FIG. 1 is a side view of a protector propeller slipper, constructed in accordance with the principles of the present invention, secured to a propeller of a motor boat.

The present invention provides a propeller protector slipper to be applied to propellers of inboard and/or outboard motors. In a preferred embodiment, the propeller protector slipper according to the subject invention includes a housing unit to envelop a propeller and a means for securing the housing unit to maintain attachment over the propeller. Advantageously, the housing unit of the subject invention is safely and easily secured over a propeller by applying minimal longitudinal force to either the port or starboard side surface opposite the cut away side.

The terms "aft," "forward," "starboard," and "port," as used herein, are common nautical terms that identify various locations in relation to a nautical vessel.

The term "anticavitation plate" as used herein refers to a plate located above the propeller blades to prevent surface air from entering the blade area.

The term "trim tab" as used herein refers to one plane installed on the lower surface of the anticavitation plate of a boat to aid in counteracting the effect of propeller rotation.

The term "lower unit gear housing" refers to the structure containing the propeller shaft and propeller.

According to the present invention, the housing unit of the propeller protector slipper may be of any suitable shape. In addition, the housing unit may include reinforcement sufficient to provide structural integrity when in use. An embodiment of the present invention has a housing unit in the shape of a rectangle. A back surface on the housing unit includes a cut away opening to accommodate the lower unit gear housing exhaust hub. The housing unit also includes a front surface and at least one side surface. In a preferred embodiment, the housing unit includes four side surfaces, a proximal and distal side surface and a top and bottom side surface. When facing the front of the housing unit, the right side of the unit is cut away to allow the propeller itself to slip into the housing unit.

In another embodiment, the housing unit is in the shape of a modified cylinder, where a portion of the cylinder is removed to form a flat side. The flat side of the modified cylindrical housing unit is cut away in order to provide a means through which a propeller may be inserted. As with the rectangular housing unit, the back surface of the modified cylindrical housing unit has a cut away portion that accommodates a lower unit gear housing exhaust hub. At the top and bottom side sections of the modified cylindrical housing unit are two (2) aligned bore holes. A dowel rod fitted for the holes is inserted through both holes. Once the rod has passed through both holes, at least one clevis pin is inserted through at least one opening drilled at the end of the dowel rod to ensure the rod does not pass through and out of the housing unit.

One embodiment of the present invention includes a dowel rod shaped in such a fashion that one end cannot pass through a bore hole and at the other end of the dowel, a hole is drilled through the dowel rod such that a clevis pin or any other object that prevents the dowel rod from slipping through the hole is inserted. The shape of the end of the dowel rod that may not pass through a bore hole might be that of a flattened rectangular, square, or bulb so long as that end of the dowel rod may not slip through the bore holes. Other means for securing the propeller protector slipper of the present invention so that the propeller remains enclosed within the housing unit include, for example, a strap having a means for fastening one end to the bottom of the housing unit (i.e. wherein the strap includes a female snap button and at the bottom side of the housing unit is a matching male snap button, or Velcro). So long as the fastening means ensures the disposition of the propeller remains within the enclosure of the housing unit.

Process for Attaching & Securing the Propeller Protector Slipper

In a method of use, the housing unit is positioned to either the port or starboard side of the propeller so that the propeller is vertically aligned with the cut-away side section. By applying minimal longitudinal force to the side of the housing unit, the propeller slips through the cut-away side section. Concurrently, the propeller shaft slides through the cut-away portion in the back of the housing unit in a longitudinal fashion to attach the present invention over the propeller. To secure the propeller protector slipper over the propeller and prevent the housing unit from detaching from the propeller, the housing unit can include, for example, 2 (two) aligned bore holes, one located at the bottom side and the other located at the top side of the housing unit near the cut away portion of the side section. The aligned holes are positioned on the housing unit such that the securing means would not be obstructed by the propeller. A dowel rod may then be inserted through both bore holes until the dowel rod has passed through both holes. Further movement of the dowel rod can be prohibited by attaching rings at both ends of the dowel rod and inserting clevis pins through each ring.

The housing unit may be made of any durable material, such as plastic, and can include means for structural reinforcement. One embodiment of the subject invention has a plastic housing unit with stiffening ribs or a bend in the material located along the edges of the sides, front and back of the housing unit to provide structural reinforcement. In another embodiment, the housing unit is composed of a metal with bends located on the sides, front and back of the housing unit to provide structural reinforcement.

Further embodiments of the subject invention provide a housing unit with a means for cushioning the enclosed propeller from damage caused by an object's impact with the housing unit. The cushioning material absorbs the kinetic energy generated by an object's impact into the housing unit and thus prevents damage to the propeller. In one embodiment of the present invention, the housing unit is composed of buoyant material to facilitate recovery of the device should it fall overboard.

Various sizes of the propeller slipper may be produced to accommodate propellers of varying sizes and taking into account blade diameter, blade pitch, and the number of blades on a propeller. The subject propeller slipper may also be used with double propellers as well as on propellers of inboard engines and propeller shafts. In addition, the dowel rod may be of any size or shape so long as it functionally prevents the housing unit from detaching from the propeller.

Conspicuous material, such as reflective or fluorescent material, may be placed upon the front surface of the housing unit to provide notice to following vehicles of the proximity of the propeller. In a further embodiment of the present invention, retroreflective tape is applied to the housing unit to provide notice to following vehicles.

In yet another embodiment of the present invention, the housing unit includes a handle at the top side surface to aid in attaching the housing unit over the propeller.

The propeller protector slipper may be installed upon the propeller to protect the propeller during transit, storage, or in the water when the motor is off. In addition, the propeller protector slipper protects the user from inadvertent contact with the propeller while in proximity to the propeller.

FIGS. 1 through 4 illustrate typical components of a propeller protector slipper according to the present invention. Specifically, housing unit 1 is placed over the propeller 3 at the propeller exhaust hub 17 using minimal longitudinal force. The propeller 3, as illustrated herein, is a single propeller. The housing unit 1 may be built to accommodate a double propeller. The housing unit 1 slips over the propeller 3 either from the port or the starboard direction, in between three different boat structures: at the aft end of the lower unit gear housing 8 and the skeg 6, below the anticavitation plate 2, and forward of the trim tab 4. The housing unit 1 includes a side that is cut away 5 and a back region that is cut away 7. At the top 9 and bottom 11 of the housing are aligned bores 13 near the cut away side 5. The bores 13 serve as channels through which a dowel rod 15 may be inserted to secure the slipper around the propeller 3. The propeller protector slipper may be longitudinally slipped over the propeller 3 from the cut away side 5 on either the port or starboard side direction while engaging the lower unit gear housing exhaust hub 17 through the cut away back region 7. One embodiment includes a handle 30 to aid in slipping the housing unit 1 over the propeller 3.

Figure 4:
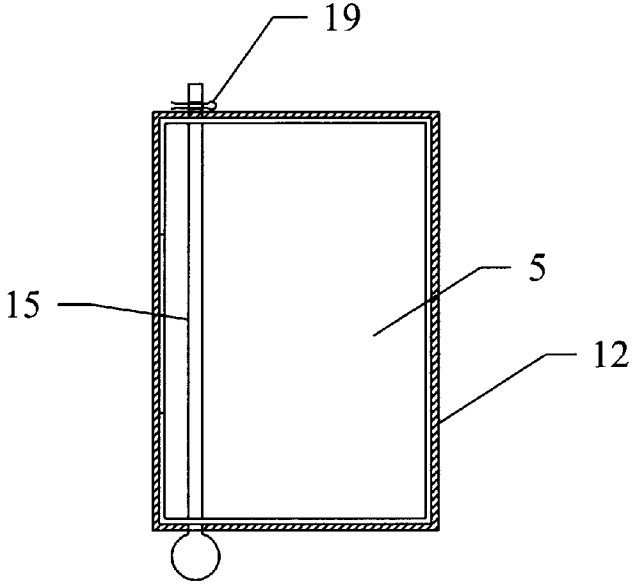
FIG. 4 is another side view of a propeller protector slipper, constructed in accordance with the principles of the present invention, depicting the cut away side surface and a means for securing the slipper to a propeller of a motor boat.
Figure 3:
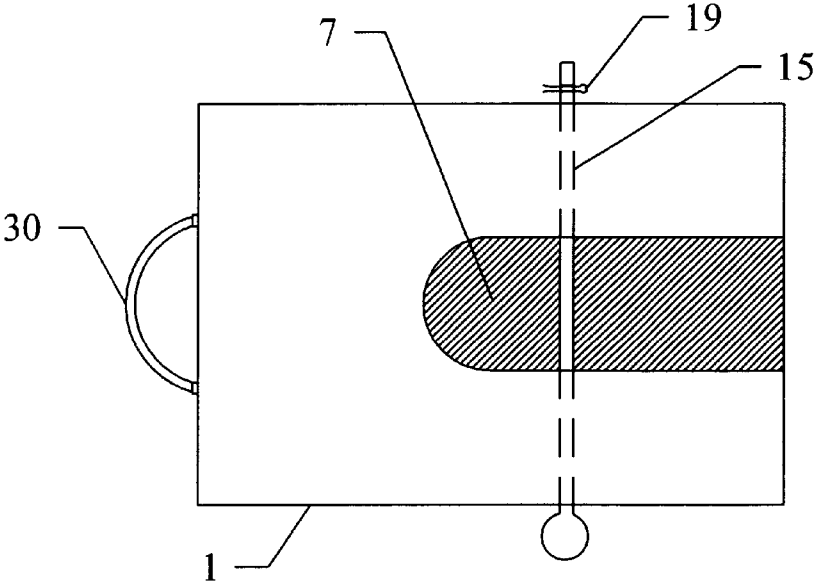
FIG. 3 is a back view of the present invention depicting the cut away region that accommodates the propeller shaft.

In an embodiment, the propeller protector slipper is secured over the propeller 3 by inserting the dowel rod 15 through the bores 13 and securing the rod 15 with a clevis pin 19. The propeller protector slipper illustrated in FIG. 2 has reinforcement 10 incorporated in the housing unit 1. Reinforcement 10 includes bending the sides of the housing unit. In addition, reinforcement 10 may also include using other known means for providing structural reinforcement, such as stiffening rods. In a specific embodiment illustrated in FIG. 3, a handle 30 is attached to the housing unit to permit ease of transport of the protector slipper. Also, the protector slipper may be colored brightly (for safety purposes) as well as semi-circular in shape to provide a more fitted slipper for the propeller. In another specific embodiment, as illustrated in FIG. 4, the housing unit 1 can include materials 12 for maintaining buoyancy. Alternatively, the housing unit 1 may be composed of materials that aid in maintaining buoyancy in water.

Figure 5:
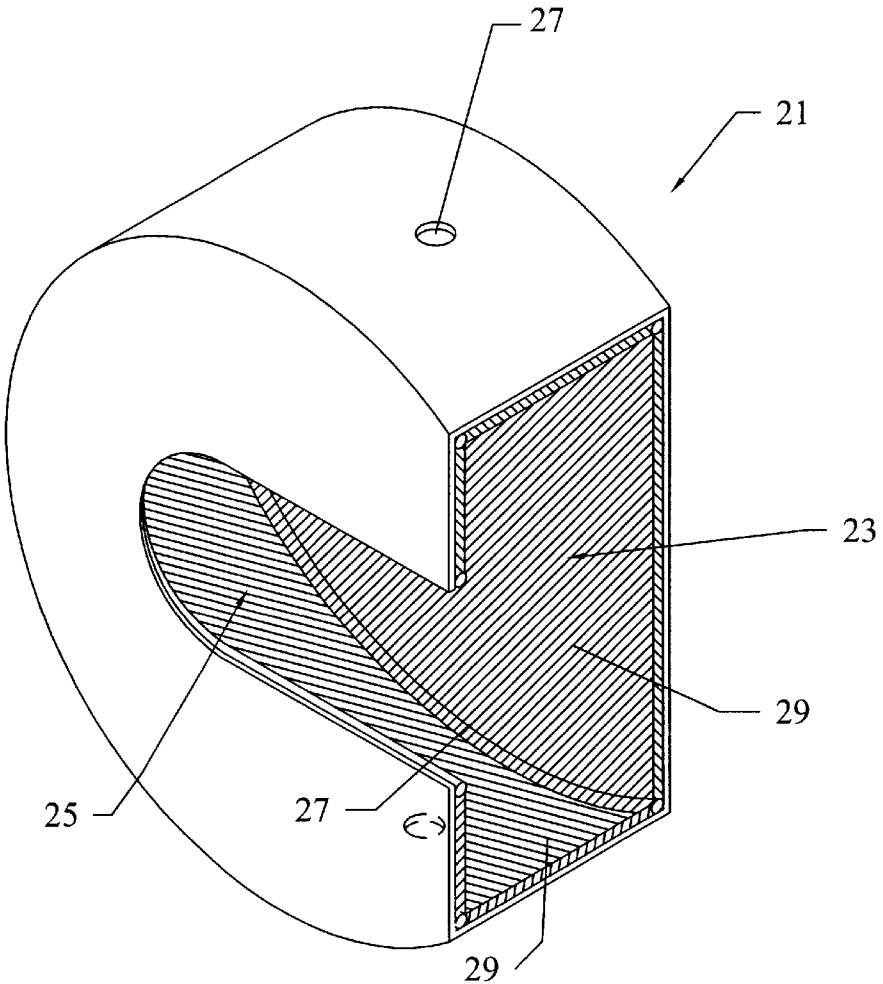
FIG. 5 is a perspective view of the subject invention with a substantially cylindrical housing unit.

FIG. 5 illustrates a related embodiment of the present invention. In FIG. 5, a substantially cylindrical housing unit 21 including a side that is cut away 23 and a back region that is cut away 25. Located on the side surface, near the cut away side 23 are aligned bores 27. The bores 27 serve as channels through which a dowel rod may be inserted to secure the slipper around a propeller. The propeller protector slipper may be longitudinally slipped over a propeller from the cut away side 23 and by engaging a propeller shaft through the cut away back region 25. Cushioning material 29 surrounds the interior of the cylindrical housing unit 21. The cushioning material 29 protects the propeller from damage by the cylindrical housing unit 21 in the event a force causes the cylindrical housing unit 21 to come into contact with the propeller. The propeller protector slipper is secured over the propeller by inserting a dowel rod through the bores 27.

All patents, patent applications, provisional applications, and publications referred to or cited herein are incorporated by reference in their entirety, including all figures, to the extent they are not inconsistent with the explicit teachings of this specification.

It should be understood that the examples and embodiments described herein are for illustrative purposes only and that various modifications or changes in light thereof will be suggested to persons skilled in the art and are to be included within the spirit and purview of this application.

What is claimed is:

1. A propeller protector slipper comprising:

a) a housing unit for enclosing a propeller, wherein the housing unit comprises an interior, an exterior, at least one side surface, a top surface, a bottom surface, a front surface, and a back surface, wherein a portion of the back surface is cut away to accommodate a propeller shaft and the side surface(s) provide a means for the propeller to slip into the housing unit; and b) a means for securing the propeller within the housing unit.

2. The propeller protector slipper according to claim 1, wherein the housing unit further comprises a cushioning means in the interior of the housing unit.

3. The propeller protector slipper according to claim 1, wherein the housing unit further comprises a means for maintaining buoyancy in water.

4. The propeller protector slipper according to claim 1, wherein the housing unit is in the shape of a modified cylinder and has two side surfaces wherein one side surface is open to allow the propeller to slip into the housing unit.

5. The propeller protector slipper according to claim 1, wherein the securing means comprises at least two aligned bore holes, wherein one bore hole is located at the top surface proximal to the open side of the housing unit, and the other bore hole is located on the bottom surface proximal to the open side surface of the housing unit; and a dowel rod having a proximal end and a distal end and of a sufficient size to be inserted through the bore holes; wherein the proximal end of the dowel rod and the distal end of the dowel rod comprise a means for ensuring the dowel rod remains engaged with the bore holes.

6. The propeller protector slipper according to claim 5, wherein the means for ensuring the dowel rod remains engaged with the bore holes comprises a hole in the distal end of the dowel rod, a clevis pin to be inserted into the dowel rod hole after the dowel rod has been inserted through the bore holes, and the proximal end of the dowel rod is shaped such that it cannot pass through the bore holes.

7. The propeller protector slipper according to claim 1, wherein the housing unit further comprises reinforcement material sufficient to provide for structural integrity.

8. The propeller protector slipper according to claim 7, wherein the housing unit is composed of plastic and the reinforcement material is additional layers of the plastic outlining the cut away back surface.

9. The propeller protector slipper according to claim 7, wherein the housing unit is composed of plastic and the reinforcement material is additional layers of rubber outlining the cut away back surface.

10. The propeller protector slipper according to claim 1, wherein the housing unit further comprises conspicuous material applied to the front surface.

11. A method for protecting a propeller comprising a) longitudinally slipping over the propeller a propeller protector slipper comprising a housing unit for enclosing a propeller, wherein the housing unit comprises an interior, an exterior, at least one side surface, a top surface, a bottom surface, a front surface, and a back surface, wherein a portion of the back surface is cut away to accommodate a propeller shaft and the side surface(s) provide a means for the propeller to slip into the housing unit; and a means for securing the propeller within the housing unit; and b) securing the propeller within the housing unit.

12. The method according to claim 11, wherein the housing unit further comprises a cushioning means in the interior of the housing unit.

13. The method according to claim 11, wherein the housing unit further comprises a means for maintaining buoyancy in water.

14. The method according to claim 11, wherein the housing unit is in the shape of a modified cylinder and has two side surfaces wherein one side surface is open to allow the propeller to slip into the housing unit.

15. The method according to claim 11, wherein the securing means comprises at least two aligned bore holes, wherein one bore hole is located at the top surface proximal to the open side of the housing unit, and the other bore hole is located on the bottom surface proximal to the open side surface of the housing unit; and a dowel rod having a proximal end and a distal end and of a sufficient size to be inserted through the bore holes; wherein the proximal end of the dowel rod and the distal end of the dowel rod comprise a means for ensuring the dowel rod remains engaged with the bore holes.

16. The method according to claim 15, wherein the means for ensuring the dowel rod remains engaged with the bore holes comprises a hole in the distal end of the dowel rod, a clevis pin to be inserted into the dowel rod hole after the dowel rod has been inserted through the bore holes, and the proximal end of the dowel rod is shaped such that it cannot pass through the bore holes.

17. The method according to claim 11, wherein the housing unit further comprising reinforcement material sufficient to provide for structural integrity.

18. The method according to claim 17, wherein the housing unit is composed of plastic and the reinforcement material is additional layers of the plastic outlining the cut away back surface.

19. The method according to claim 17, wherein the housing unit is composed of plastic and the reinforcement material is additional layers of rubber outlining the cut away back surface.

20. The method according to claim 11, wherein the housing unit further comprises retroreflective tape applied to the front surface.

* * * * *

UNITED STATES PATENT AND TRADEMARK OFFICE

CERTIFICATE OF CORRECTION

PATENT NO. : 6,609,938 B1
DATED : August 26, 2003
INVENTOR(S) : Allan Pither

It is certified that error appears in the above-identified patent and that said Letters Patent is hereby corrected as shown below:

Column 1,
Line 31, "portion of stem drive system" should read -- portion of stern drive system --.
Line 42, "portion of the stem drive" should read -- portion of the stern drive --.

Column 3,
Line 23, "to the stem of the propeller" should read -- to the stern of the propeller --.

Signed and Sealed this

Eighteenth Day of November, 2003

JAMES E. ROGAN
*Director of the United States Patent and Trademark Office*